US005685434A

United States Patent [19]

Ackerman

[11] Patent Number: 5,685,434

[45] Date of Patent: Nov. 11, 1997

[54] VERTICAL DROP PRODUCT CLEANER

[76] Inventor: Kyle D. Ackerman, 16754 705th Ave., Dassel, Minn. 55325

[21] Appl. No.: 552,472

[22] Filed: Nov. 9, 1995

[51] Int. Cl.[6] ..... B07B 4/00

[52] U.S. Cl. ..... 209/135; 209/142; 209/149; 209/154

[58] Field of Search ..... 209/134–137, 209/142, 143, 149, 154

[56] References Cited

U.S. PATENT DOCUMENTS

| | | | |
|---|---|---|---|
| 2,041,591 | 5/1936 | Brown et al. | 209/137 X |
| 4,568,453 | 2/1986 | Lowe, Jr. | 209/137 X |
| 4,865,721 | 9/1989 | Smith et al. | 209/135 |

*Primary Examiner*—David H. Bollinger

[57] ABSTRACT

The present invention provides a vertical drop, multi-pass cleaner comprising a housing and first and second panels defining a separation plenum therebetween through which the product drops substantially vertically through an upwardly directed air flow and a plurality of cross air flows. The panels are mounted on tracks within the housing and are separately removable from the housing as desired by the operator for cleaning or repair. The present invention may also includes a velocity control module having metering vanes to control the air flow through individual ones of the plurality of cross flow air passages, the vanes being either manually or automatically adjusted.

21 Claims, 4 Drawing Sheets

VERTICAL DROP PRODUCT CLEANER

FIELD OF THE INVENTION

The present invention relates generally to equipment, machinery or other apparatus used to clean granular product and particularly to such equipment utilizing a gravity flow of dirty product through an upward directed, substantially vertically oriented air flow and through a plurality of transverse air flows that remove the fines and/or foreign matter present in the product therefrom and thus cleans it.

BACKGROUND OF THE PRESENT INVENTION

The use of air flows to remove fines and other foreign material from a dry granular product is well known in the art. An exemplary example of such a use is shown in U.S. Pat. No. 4,865,721 to Smith et al., which is assigned to the assignee of the present invention.

The '721 patent discloses a vertical drop, multi-pass cleaner or aspirator of dry granular product. In its broadest sense, as shown and described therein, such a cleaner relies upon an upward vertical air movement through a granular product falling under gravitational influence and a horizontal or transverse airflow to separate the fines and foreign material from the product and carry it away therefrom. In other words, the '721 patent describes an apparatus that removes fines and foreign material from dry, free flowing particulate matter by using substantially perpendicular air flows through the flowing product.

The apparatus described in the '721 patent performs its function of cleaning product admirably. Cleaning and repair of the apparatus is a problem, however. As product is cleaned using the apparatus fines and foreign material can build up on some of the surfaces, interfering with an efficient cleaning operation. This build up of fines and foreign material is difficult to remove. The cleaner described therein is formed by welding the various components together to create a strong, integral product cleaner. This unitary structure makes cleaning apparatus difficult. It also interferes with the owner/operator's ability to replace damaged or broken components. In addition, the apparatus shown in the '721 patent does not demonstrate any ability to control the cross-wise negative pressure air flows through the apparatus and the flowing product.

It would be desirable to have an apparatus for cleaning dry, free-flowing granular product that was easy to clean and repair and that allowed the operator to control more readily the air flow through the apparatus.

SUMMARY OF THE INVENTION

It is an object of the present invention to provide new and improved apparatus that is not subject to the foregoing disadvantages.

It is another object of the present invention to provide a vertical drop cleaner that is more easily cleaned than known prior art cleaners of this type.

It is still another object of the present invention to provide a vertical drop cleaner that is more easily repaired than know prior art cleaners of this type.

It is yet another object of the present invention to provide a vertical drop cleaner that enables the operator to control the air flow, particularly the substantially transverse air flows, through the free flowing product.

The foregoing objects of the present invention are provided by a vertical drop, multi-pass cleaner comprising a housing and first and second panels defining a separation plenum therebetween through which the product drops substantially vertically through an upwardly directed air flow and a plurality of cross air flows. The panels are separately removable from the housing as desired by the operator for cleaning or repair. The first and second panels each include upper and lower attachment structures that engage upper and lower engagement structures disposed in the housing. The present invention also includes a velocity control module having metering vanes to control the air flow through individual ones of the plurality of cross flow air passages, the vanes being either manually or automatically adjusted in response to sensors detecting the air flow cross-wise air flow.

The foregoing objects of the invention will become apparent to those skilled in the art when the following detailed description of the invention is read in conjunction with the accompanying drawings and claims. Throughout the drawings, like numerals refer to similar or identical parts.

DETAILED DESCRIPTION OF THE INVENTION

Figure 1:
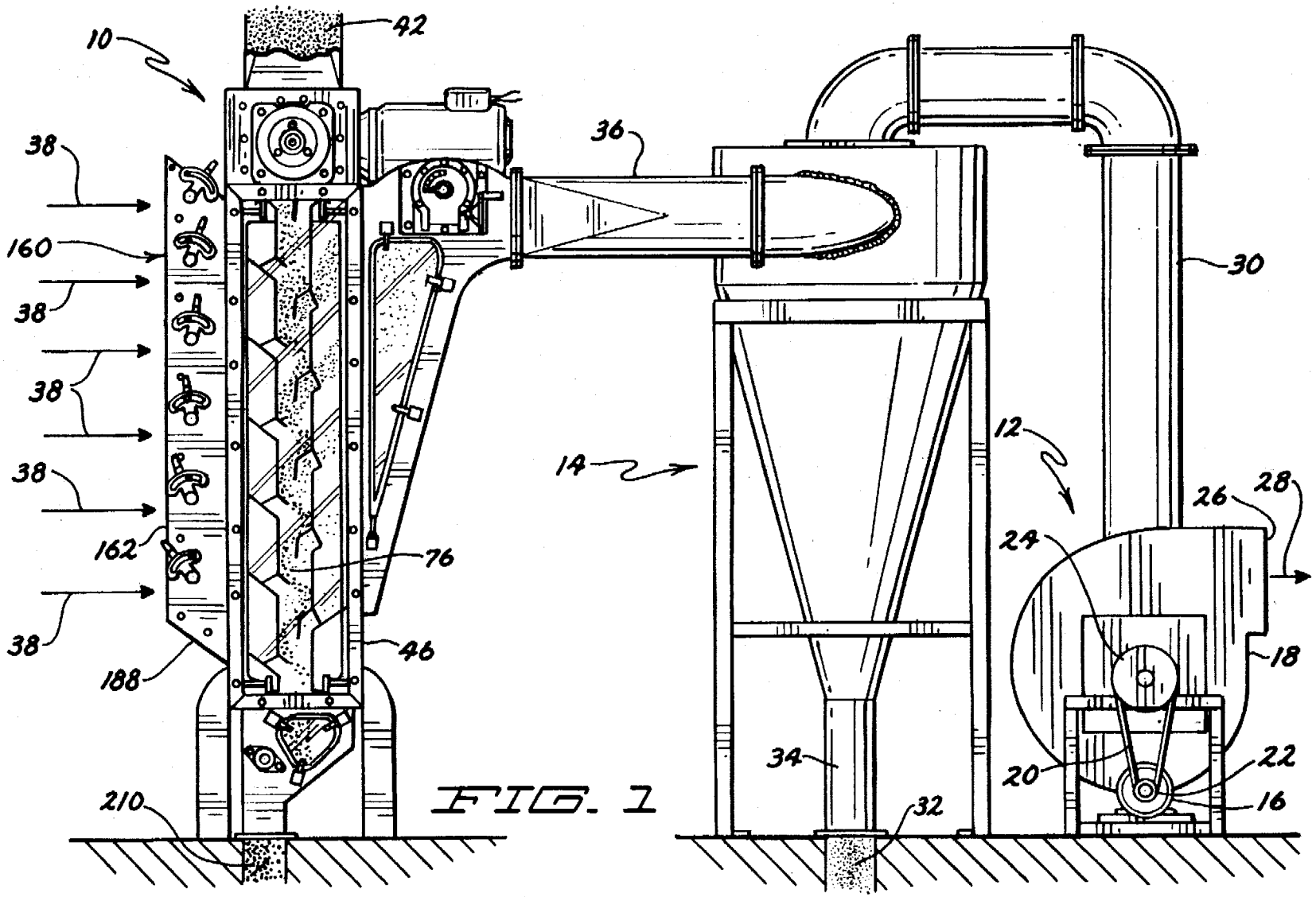
FIG. 1 is a side elevation, partial cross sectional view showing apparatus in accord with the present invention in an open circuit configuration fluidly connected to a cyclone-type dust collector and blower.

FIG. 1 illustrates a side elevation, partial cross sectional view, of a product cleaner apparatus 10 according to the present invention. The cleaner 10 is shown in an open circuit configuration, that is, in a configuration where air from the ambient environment is continuously drawn therein by a negative air pressure created by a fan or blower 12 of known type. The cleaner 10 is shown attached to a cyclone-type dust collector 14 of known type.

Blower 12 includes a motor 16 that drives an impeller (not seen) contained within a blower housing 18 that is driven by the motor 16 through a belt 20 extending between a pulley 22 attached to the motor 16 and a pulley 24 attached to the impeller. The blower 12 blows air out through an air outlet 26 as indicated by arrow 28.

Blower 12 is fluidly connected to the dust collector 14 by an air outlet 30. Fines and other foreign material 32 settle out of the air flow passing through the collector 14 and drop out of the bottom thereof through an outlet 34 where it is collected and disposed of in any known, environmentally safe manner. The dust collector 14 in turn is fluidly connected to the product cleaner 10 by an air outlet 36. Air flows into the cleaner 10 from the ambient environment as indicated by arrow 38 as a result of the negative air pressure created by the blower 12. This air flow 38 into the cleaner 10 is used to remove fines and other foreign materials from the product to be cleaned.

Cleaner 10 will now be described with principal reference to FIGS. 1, 3A and 3B. Cleaner 10 includes a charging inlet 40 into which dirty product 42 to be cleaned is placed in known manner. The dirty product 42 is held in a charging hopper 44 and metered into housing 46 by a metering reel 48 that extends the substantially the length of the housing 46. The metering reel 48 acts to deliver product 42 into the housing 46 in a controlled, measured manner. Thus, the reel 48 is mounted for rotation on a shaft 50 that is rotated in known manner. Dirty product 42 is received between the substantially radially extending vanes 52 of the metering reel 48 along the top thereof and carried by the rotation of the reel 48 to a hopper discharge outlet 54 therebelow such that the product 42 can fall into the housing 46, as best seen in FIG. 1.

Figure 2:
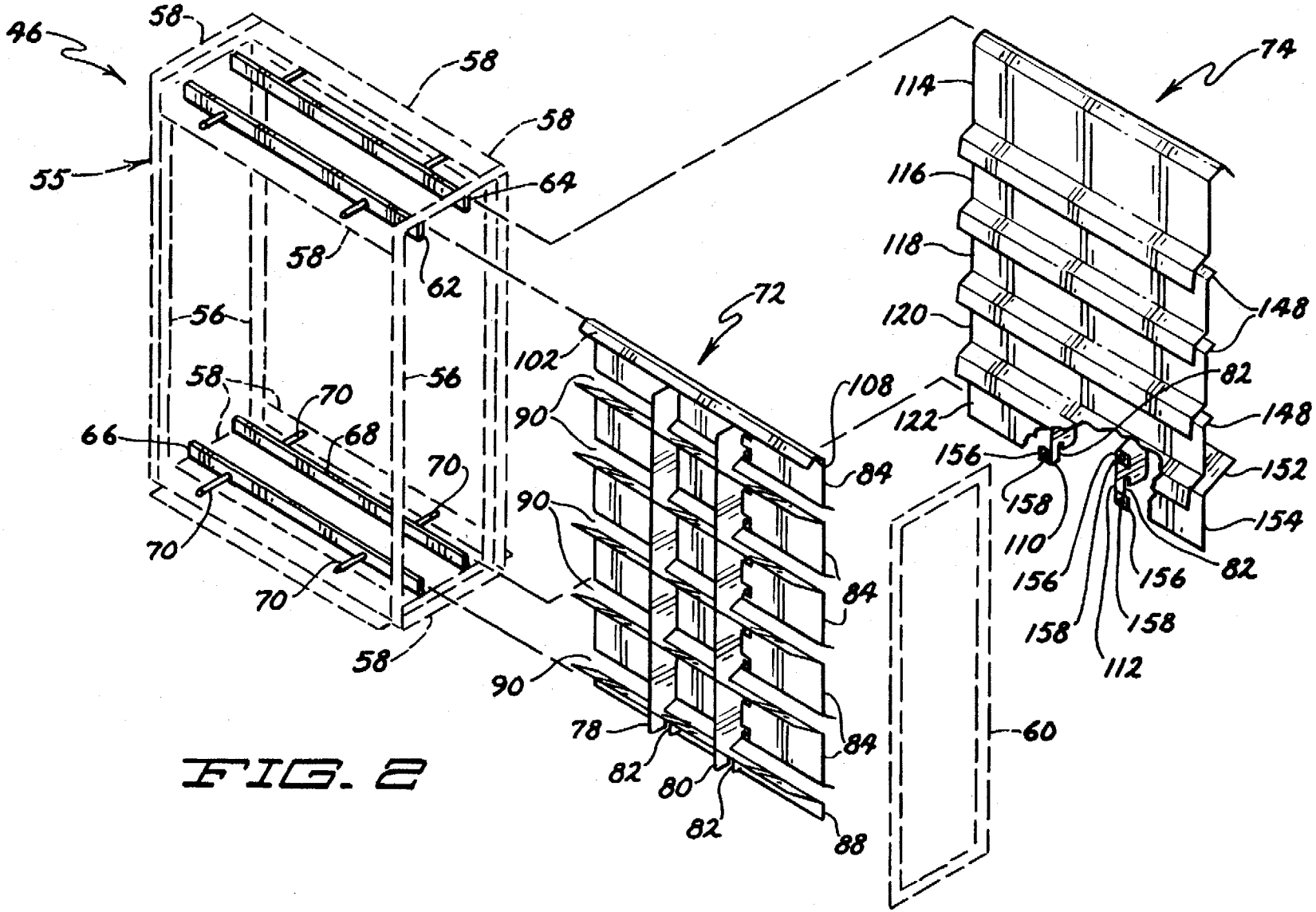
FIG. 2 is an exploded perspective view of an aspirator cleaner in accord with the present invention.

Housing 46 is seen in FIG. 2 to comprise an external skeleton 55. Skeleton 55 includes upright corner members 56, illustrated in phantom outline to more clearly show the present invention, and transverse members 58 extending between the corner members 56 at opposite ends thereof. As shown, skeleton 55 has a substantially rectangular cross section. Housing 46 further includes a pair of end panels 60 mounted to opposing sides of the housing 46 in any known manner such as nuts and bolts. End panels 60 are desirably made of Lexan® synthetic material, manufactured by General Electric Company. Lexan® material is a clear, i.e., transparent, material that allows the operator to view the interior of the housing during cleaning operations. Other transparent materials may also be used for the end panels. To facilitate their removal, end panels 60 are preferably attached by means of hand manipulable fasteners such as wing nuts or the like, thus alleviating the need for tools to remove the end panels.

Housing 46 also includes a pair of mounting rails 62 and 64 attached at the upper end thereof and a pair of mounting rails 66 and 68 attached at the lower end thereof. Mounting rails 62, 64, 66, and 68 are attached to the skeleton 55 by means of elongate attachment members 70 that are attached to the transverse members 58. As shown, members 70 have a cylindrical configuration and provide a stand-off function of spacing the mounting rails inwardly from the transverse members 58.

Mounting rails 62 and 66 removably mount an inlet manifold 72 and mounting rails 64 and 68 removably mount an outlet manifold 74. Manifolds 72 and 74 are mounted within housing 46 by the rails 62–68 so as to be spaced apart and define therebetween a separation plenum 76. Hopper discharge outlet 54 feeds dirty product 42 into the separation plenum 76 for cleaning of fines and foreign matter from the product.

Inlet manifold 72 comprises a pair of ribs 78 and 80 that extend substantially upright. Ribs 78 and 80 each include a slot 82 that is configured to receive and slide upon the lower mounting rail 66 when the inlet manifold 72 is disposed in position in housing 46. Thus, the slots are preferably configured to have configuration that matches that of the mounting rail 66, which as shown in the present embodiment is substantially rectangular but could within the scope of the present invention take on other configurations.

Ribs 78 and 89 mount thereto a plurality of middle louvers 84, a top louver 86, and a bottom louver 88. The louvers 84–88 are spaced apart so as to define air inlets 90 therebetween. As shown in the present embodiment there are four middle louvers 84 and six air inlets 90, though the exact number is not critical to the present invention and may be varied as desired or as needed for the product being cleaned.

Each middle louver 84 includes upper and lower inlet lips 92 and 94, respectively. Upper inlet lips 92 extend outward in the direction of the inwardly moving airflow 38 while lower inlet lips 94 extend inwardly into the separation plenum 76. The lips 92 and 94 are interconnected by a substantially vertically extending louver member 96.

Top louver 86 includes a lower lip 98 that extends into the space between the manifolds, an upright extending member 100, and a hook element 102. Hook element 102 is configured to extend over and somewhat around mounting rail 62 and to be slidably received thereby. Thus, when it is desired to clean, maintain or replace the inlet manifold 72, the end panel 60 can be removed and the manifold 72 can quickly and easily be slidably removed from the housing of the product cleaner 10 by a single individual. The necessary cleaning, maintenance or replacement of the manifold can be accomplished and the manifold restored to its operation position within the housing 46. As shown, the hook element 102 comprises a first, upwardly and outwardly extending member 104 and a second, downwardly and outwardly extending member 106. Members 104 and 106 together create a recess 108 at the members juncture therebelow. The recess 108 receives the mounting rail 62. Thus, as shown, hook element 102 comprises a pair of angularly disposed members that create a hook by which the inlet manifold 72 can be supported from the mounting rail 62. Other configurations of the hook element 102 could also be used with the present invention. For example, a smoothly bending single member could be used with the present invention as could a hook element formed of more than two members.

The lower louver 88 includes an upper lip 92 similar to the upper lips of the middle louvers 84. Lower louver 88 has no lower lip in the present embodiment, though such a lip could be provided if desired.

Outlet manifold 74 has a similar construction to the inlet manifold 72 in the present embodiment. That is, it includes a pair of upright extending ribs and a plurality of longitudinally, that is, substantially horizontally extending louvers. Thus, outlet manifold 74 includes ribs 110 and 112, top louver 114, middle louvers 116, 118, 120, and 122, and bottom louver 124. The outlet manifold louvers are spaced vertically apart from each other along the upward extent of the ribs 110 and 112 and extend substantially the entire length of the housing 46. As with the inlet manifold 72, the spacing of the louvers 116–124 creates air outlets 126 for the transverse air flows with five such outlets being shown in FIGS. 3A and 3B. A sixth air outlet 128 is created between the outlet manifold top louver 114 and a downwardly depending member 130 attached to the charging hopper 44 and extending into the hopper discharge outlet 54.

Outlet manifold top louver 114 comprises a hook element 132, an upright or substantially vertically extending member 134, and a lower lip element 136. Lower lip element 136 comprises, as shown, a first inward and downward extending segment 138 and a second inward and downwardly extending segment 140 angularly disposed relative to the first segment 138. The hook element 132 includes first and second hook angularly disposed members 142 and 144, respectively, which are similar to the first and second hook members 104 and 106 of the top louver 86 of the inlet manifold 72. The juncture of the first and second hook members 142 and 144 forms a recess 146 to slidably receive the mounting rail 64.

The middle louvers 116–120 each include an upper lip 148, a lower lip element 136, and an upright or substantially vertically extending member 150 therebetween. The upper lips 148 of one louver and the lower lip element of the next adjacent louver therebelow define the air outlets 126 therebetween.

The lower louver 122 includes an extended upper lip 152 and an upright or substantially vertically extending member 154.

The ribs 110 and 112 each include slots 82 at their lower ends that are configured to slidably receive the mounting rail 68.

Outlet manifold 74 can thus be slidably removed from the housing 46 as desired for cleaning, maintenance or replacement by the operator of apparatus 10. Where such remedial work is desired, the end panel 60 can be removed, the outlet manifold can be slid outwardly on the mounting rails and the remedial work accomplished. It will be observed with respect to FIG. 2 that the ribs 82 each include at least one flange 156 extending therefrom substantially parallel with the extent of the louvers and including a bolt hole or aperture 158 by which the louvers of manifold 74 can be removably secured to the ribs. The louvers can also be welded to the ribs if desired. Inlet manifold ribs 82 are similarly constructed, though such flanges and are not shown therefore.

The use of replaceable, easily removable manifold modules in a vertical drop aspirator or cleaner like that shown herein enables the stacking and assembly of multiple manifolds to create larger, longer cleaning apparatus than can readily be presently formed and operated. The present invention thus provides a significant advantage over the prior art devices.

Figure 3A:
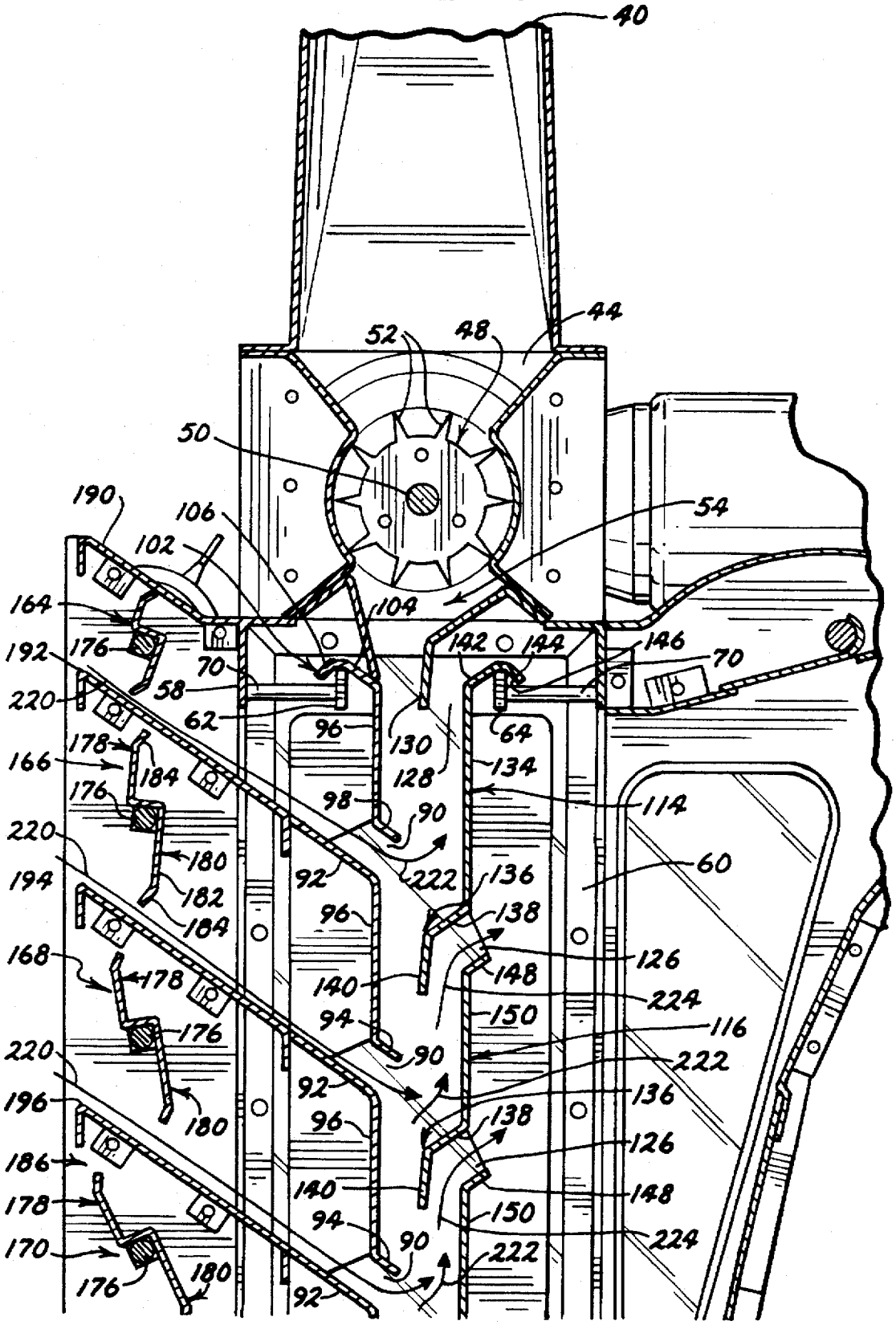
FIGS. 3A and 3B is an end view of the apparatus shown in FIG. 1 in a partial cross sectional view.
Figure 3B:
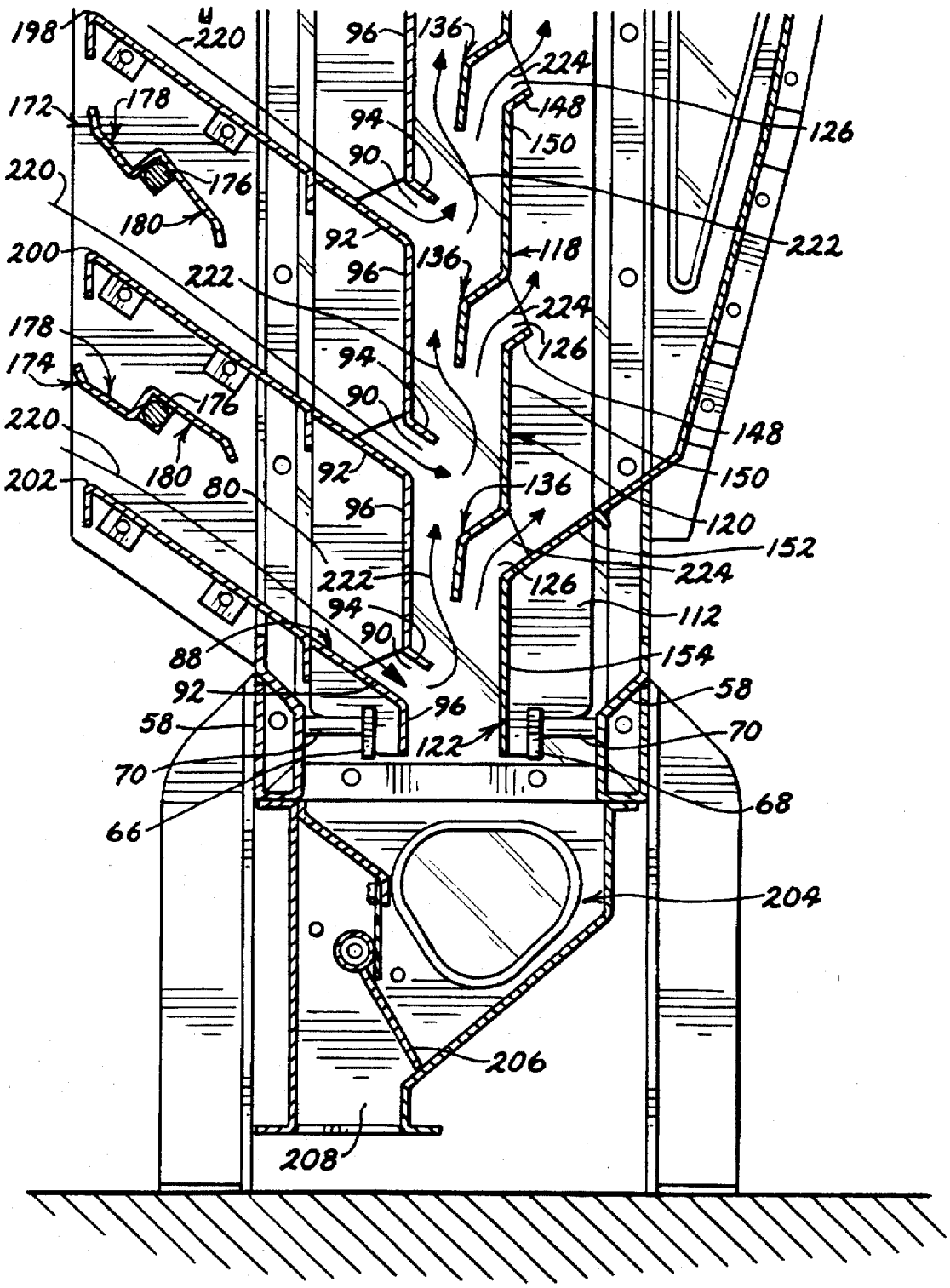

Referring now to FIGS. 1, 3A and 3B, it will be observed that the present invention 10 may be equipped with an velocity control module 160. Module 160 can be attached to the air inlet side of the housing 46 and includes a plurality of dampers that can be selectively adjusted to control the airflow passing through each of the air inlets 90. The adjustment for the individual air inlets can be made manually or automatically based upon sensed readings of the air flow through the individual air inlets.

Module 160 includes a module housing 162. Mounted therein are a plurality of dampers 164, 166, 168, 170, 172, and 174 that extend substantially the length of the housing 46. Each damper 164–172 is mounted for synchronous rotation with and on a damper shaft 176. Each damper 164–172 includes a pair of damper vanes 178–180 that extend outwardly from the shaft 174. The vanes 178 and 180 each include a radially inward first portion 182 and a radially outward second portion 184 angularly disposed relative thereto. Each damper 164–174 is contained within its own damper unit or air passage comprising end walls 186 and 188 of the module 160 ceiling and floor elements. It will be observed that damper 164 has a ceiling element 190 and a floor element 192 while damper 166 immediately therebelow has a ceiling element formed by floor element 192 of damper 164 and a floor element 194. The module 160 thus includes a plurality of inwardly and downwardly extending dividers 190, 192, 194, 196, 198, 200, and 202 that engage the upper lips 92 of the inlet manifold louvers so as to cooperate in defining a flow path or air passage for ambient air entering the velocity control module and the product cleaner 10. Each air passage communicates with one of said air inlets 92. Rotation of the shafts 176 causes the vanes to rotate therewith and to open or close the air passage accordingly. That is, rotation of the shafts 176 and thus the vanes changes the size of the corresponding air passage and thus enables the operator to control the air flow through the passage into its respective air inlet 92. With the use of the velocity control module 160 the volume and velocity of ambient air entering the cleaner 10 can be controlled such that the cleaning operation can more efficiently take place.

It will be understood that the construction of the product cleaner 10, the velocity control module 160, and the various other portions of the apparatus shown in the Figures will be of sheet metal materials of sufficient strength and thickness to withstand the forces and wear and tear that such equipment is understood to experience in operation.

Referring now to FIG. 1, it will be observed that product enters the cleaner 10 and is metered into the separation plenum 76. As the product falls under gravitational influence it cascades alternately back and forth across the plenum 76 due to the action of engaging the upper and lower lips of the louvers forming the inlet and outlet manifolds. Thus, as a representative example of such falling action, falling product will engage the lower lip element 136 of an air outlet manifold louver and be directed thereby, that is, given a velocity component substantially transverse to the gravitational velocity, in the direction of the opposing air inlet manifold louver on the opposing side of the separation plenum 76. The product will "bounce" to the other side of the separation plenum where it will engage the upright portion 96 and lower lip 94 of an inlet manifold louver, the lower lip 94 redirecting the falling product back across again. It this way the falling product is tumbled by the inwardly extending lower lips of the manifold louvers to expose the surface of the granular product to the upward and transverse air flow through the apparatus for removal of fines and other materials and to expose the fines and foreign materials to the air flow to allow and facilitate its removal from the falling product, thus cleaning it.

Referring now to FIGS. 1 and 3B, as the falling product encounters the lower lip 94 of the lower louver 88 it falls into a discharge hopper 204. Hopper 204 may include a spring loaded or biased discharge gate 206 as shown. The cleaned product 210 will fall out of the hopper 204 through a discharge chute 208 and into the appropriate product conveyor (not shown) to be conveyed away for use or transport as desired.

OPERATION OF THE PRESENT INVENTION

It will be understood that the basic operation of the present invention is substantially similar to that described in the '721 patent. Thus, blower 12 will create a negative air pressure within the apparatus 10, causing ambient air to enter the velocity control module 160 as indicated by arrow 38 and pass through the apparatus shown in FIG. 1 to exit therefrom as indicated by arrow 28. More specifically, ambient air will enter the velocity control module 160 and will pass through the air inlets 90 into the separation plenum 76 as indicated by arrows 220 shown in FIGS. 3A and 3B.

As the air flow 220 enters the separation plenum it will split into an upwardly directed air flow through the falling product 42, as indicated by arrow 222, and a transverse air flow exiting the through the air outlets 126 as indicated by arrow 224. The upward air flow 222 "fluffs" the falling product and separates the fines and foreign materials contained therein therefrom, allowing the transverse air flow 226 to carry the fines and foreign materials away through the air outlets 126 and into the air outlet 36 to the collector 14 where it settles out as previously described. In this manner, then, the dirty product 42 is cleaned to yield clean product 210 and fines and foreign materials 32.

The velocity control module 160 aids in the cleaning process by controlling the flow and velocity of air through the falling product. As readily seen, the shortest path through the apparatus 10 for any air flow would be through the an upper air inlet 90 and out an upper air outlet 126. Under normal circumstances, air flowing into the cleaner 10 from the ambient under the negative air pressure created in the cleaner by the blower 10 would take the shortest path therethrough. In such circumstances, there would be a reduced air flow through the lower air inlets and consequently less efficient cleaning of the falling dirty product. By using the dampers to control the air flow through the individual air inlets 90 a desired amount of incoming air can be directed through the lower air inlets, allowing it to move upwardly through the falling product to clean it more efficiently.

With the present invention, then, the modular nature of the manifolds 72 and 74 will reduce equipment downtime. Repair and/or replacement of the individual manifolds can be accomplished in minutes without the aid or tools and required lifting aids. The present invention eliminates contact of the falling product with the housing, thus eliminating its wear and tear and thus virtually eliminating the need to ever replace the housing. Product cleaning is enhanced by the addition of a velocity control module if desired by the operator.

The present invention having thus been described, other modifications, alterations, or substitutions may now suggest themselves to those skilled in the art, all of which are within the spirit and scope of the present invention. It is therefore intended that the present invention be limited only by the scope of the attached claims below.

What is claimed is:

1. An aspirator for separating fines and/or foreign matter from dry, free-flowing, granular product, said aspirator comprising:

a housing;

a charging hopper;

a discharge for conducting the granular material from said aspirator;

a separation plenum formed by spaced inlet and outlet manifolds and spaced end walls contiguous with said manifolds and extending vertically downwardly from said charging hopper to said discharge, said separation plenum adapted to communicate with said charging hopper and said discharge to thereby conduct product from said charging hopper downwardly to said discharge;

said inlet manifold defining at least one air inlet providing a flow path for air into said separation plenum;

said outlet manifold defining at least one air outlet providing a flow path for air out of said separation plenum;

an upper rail for removably mounting at least one removable manifold thereto, said rail extending substantially the entire length of said housing and being rigidly attached therein, said at least one removable manifold including a hook for removably suspending said removable manifold from said rail, wherein said at least one removably mounted manifold can be quickly and easily removed for cleaning, maintenance, and/or replacement thereof.

2. The aspirator of claim 1 wherein said hook extends substantially the entire length of said at least one removable manifold.

3. The aspirator of claim 2 wherein said at least one removable manifold comprises at least a pair of louvers vertically spaced apart to define an air inlet therebetween into said separation plenum.

4. The aspirator of claim 3 wherein said hook comprises an upper member of the upper louver of said pair of louvers, said upper member including at least one segment forming a recess into which said rail is slidable received.

5. The aspirator of claim 1 and further including a lower rail disposed substantially vertically below said upper rail, said at least one removable manifold slidably engaging said lower rail, said lower rail cooperating with said upper rail for removably mounting said removable manifold within said housing.

6. The aspirator of claim 5 wherein said at least one removable manifold comprises:

first and second rib members extending substantially parallel to each other; and at least a pair of spaced apart, elongate louvers defining therebetween an air inlet communicating with said separation plenum.

7. The aspirator of claim 6 wherein said at least one removable manifold comprises a hook for suspending said removable manifold from said upper rail.

8. The aspirator of claim 7 wherein at least one of said ribs includes a mating slot configured to slidably receive said lower rail and be supported thereby within said housing.

9. The aspirator of claim 6 wherein at least one of said ribs includes a mating slot configured to slidably receive said lower rail and be supported thereby within said housing.

10. The aspirator of claim 1 wherein said inlet manifold comprises a plurality of horizontally-extending, vertically-spaced air inlets and said outlet manifold comprises a plurality of horizontally-extending, vertically-spaced air outlets.

11. The aspirator of claim 10 wherein said housing comprises a pair of upper and lower rails extending horizontally within said housing and wherein said aspirator includes means for removably mounting said inlet and outlet manifolds to said upper and lower rails within said housing.

12. The aspirator of claim 11 wherein said outlets are disposed substantially opposite to and above said inlets.

13. The aspirator of claim wherein 11 said manifolds each comprise a pair of ribs extending substantially vertically and substantially parallel to each other and wherein said inlets and outlets are defined by a plurality of horizontally extending louvers.

14. The aspirator of claim 13 wherein said ribs each include a mating slot at the lower ends thereof, said mating slots configured to slidably receive one of said lower rails.

15. The aspirator of claim 14 wherein said inlet manifold includes a plurality of air inlets and said air outlet includes a plurality of air outlets, said aspirator further including means for selectively controlling the air flow through each of said air inlets.

16. The aspirator of claim 15 wherein said means for selectively controlling the air flow comprises a velocity control module, said module comprising a plurality, of air passages and a plurality of dampers disposed in said corresponding plurality of air passages, at least one of said dampers being rotatable so as to vary, the air flow through said passage each of said air passages communicating with one of said air inlets and wherein said module further comprises means for selectively rotating said at least one damper.

17. The aspirator of claim 14 wherein said inlet manifold includes a plurality of air inlets and said air outlet includes a plurality of air outlets, said aspirator further including a velocity control module, said module being provided for selectively controlling the air flow through each of said air inlets said module comprising a plurality of air passages and a plurality of dampers disposed in said corresponding plurality of air passages said dampers being rotatable so as to vary the air flow through said passages each of said air passages communicating with one of said air inlets said dampers each comprising a pair of vanes extending outwardly from a rotatable shaft, said vanes being rotatable with said shaft to control the size of said air passage and the amount of air passing therethrough to its respective air inlet.

18. The aspirator of claim 15 wherein said means for selectively controlling the air flow comprises a velocity control module, said module comprising a plurality of air passages and a plurality of dampers disposed in said corresponding plurality of air passages, at least one of said dampers being rotatable so as to vary the air flow through said passage each of said air passages communicating with one of said air inlets, wherein said at least one damper comprises a pair of vanes extending outwardly from a rotatable shaft, said vanes being rotatable with said shaft to control the size of said air passage and the amount of air passing therethrough to its respective air inlet.

19. An aspirator for separating fines and/or foreign matter from dry, free-flowing, granular product, said aspirator comprising:

a housing, said housing comprising a pair of upper and lower rails extending horizontally within said housing;

a charging hopper;

a discharge for conducting the granular material from said aspirator;

a separation plenum formed by spaced inlet and outlet manifolds and spaced end walls contiguous with said manifolds and extending vertically downwardly from said charging hopper to said discharge, said separation plenum adapted to communicate with said charging hopper and said discharge to thereby conduct product from said charging hopper downwardly to said discharge;

said inlet manifold defining at least one air inlet providing a flow path for air into said separation plenum;

said outlet manifold defining at least one air outlet providing a flow path for air out of said separation plenum; and means for removably mounting at least one of said manifolds to said upper and lower rails such that such manifold can be quickly and easily removed for cleaning, maintenance, and/or replacement, said means for removably mounting comprising a pair upper and lower rails extending horizontally within and attached to said housing and said at least one removably mounted manifold includes at least one hook for removably suspending said at least one removable manifold from said rails.

20. The aspirator of claim 19 wherein said inlet manifold includes a plurality of air inlets and said air outlet includes a plurality of air outlets, said aspirator further including a velocity control module, said module being provided for selectively controlling the air flow through each of said air inlet, said module comprising a plurality of air passages and a plurality of dampers disposed in said corresponding plurality of air passages, said dampers being rotatable so as to vary the air flow through said passages, each of said air passages communicating with one of said air inlets, said dampers each comprising a pair of vanes extending outwardly from a rotatable shaft, said vanes being rotatable with said shaft to control the size of said air passage and the amount of air passing therethrough to its respective air inlet.

21. An aspirator for separating fines and/or foreign matter from dry, free-flowing, granular product, said aspirator comprising:

a housing, said housing comprising a pair of upper and lower rails extending horizontally within said housing;

a charging hopper;

a discharge for conducting the granular material from said aspirator;

a separation plenum formed by spaced inlet and outlet manifolds and spaced end walls contiguous with said manifolds and extending vertically downwardly from said charging hopper to said discharge, said separation plenum adapted to communicate with said charging hopper and said discharge to thereby conduct product from said charging hopper downwardly to said discharge;

said inlet manifold defining at least one air inlet providing a flow path for air into said separation plenum;

said outlet manifold defining at least one air outlet providing a flow path for air out of said separation plenum; and wherein said inlet manifold includes a plurality of air inlets and said air outlet includes a plurality of air outlets, said aspirator further including a velocity control module, said module being provided for selectively controlling the air flow through each of said air inlet, said module comprising a plurality of air passages and a plurality of dampers disposed in said corresponding plurality of air passages, said dampers being rotatable so as to vary the air flow through said passages, each of said air passages communicating with one of said air inlets, said dampers each comprising a pair of vanes extending outwardly from a rotatable shaft, said vanes being rotatable with said shaft to control the size of said air passage and the amount of air passing therethrough to its respective air inlet.

* * * * *